United States Patent [19]

San Pietro

[11] 4,116,567

[45] Sep. 26, 1978

[54] PRINTER SYNCHRONIZATION CONTROL FOR SHUTTLE HAVING NON-UNIFORM VELOCITY

[75] Inventor: Craig San Pietro, Philadelphia, Pa.

[73] Assignee: Okidata Corporation, Moorestown, N.J.

[21] Appl. No.: 756,339

[22] Filed: Dec. 22, 1976

[51] Int. Cl.[2] ..... B41J 3/04

[52] U.S. Cl. ..... 400/124; 101/93.05

[58] Field of Search ..... 197/1 R, 19, 66; 340/324 AD; 101/93.05

[56] References Cited

U.S. PATENT DOCUMENTS

| | | | |
|---|---|---|---|
| 3,167,166 | 1/1965 | Schiebeler | 197/1 R |
| 3,858,703 | 1/1975 | Duley | 197/1 R |
| 3,882,988 | 5/1975 | Sloan et al. | 197/66 |
| 3,896,428 | 7/1975 | Williams | 340/324 AD |
| 3,941,051 | 3/1976 | Barrus et al. | 197/1 R X |
| 3,970,183 | 7/1976 | Robinson et al. | 197/1 R |
| 3,973,662 | 8/1976 | Fulton | 197/1 R |
| 4,027,761 | 6/1977 | Quaif | 197/1 R |
| 4,029,192 | 6/1977 | Manthiram | 197/19 |

*Primary Examiner*—Ernest T. Wright, Jr.
*Attorney, Agent, or Firm*—Seidel, Gonda & Goldhammer

[57] ABSTRACT

A printer synchronization control for maintaining columnar alignment of dots printed by a dot matrix printer including a shuttle wherein the relative velocity between the paper and shuttle is non-uniform. Plural print elements are mounted on the shuttle for printing dots at preselected positions on the paper. A particular row and column arrangement of the dots defines a character. A counter measures the relative velocity between the paper and shuttle over a period of time inversely proportional to the relative velocity. A second counter determines the time at which an actuator must be triggered to cause a print element to strike the paper at a preselected columnar position to maintain columnar alignment of the dots in a character. Means are provided for causing the print element to strike the paper at the preselected columnar position as a function of the second counter. A third counter may be provided to enable two or more sets of the print elements to be actuated in time-staggered fashion to minimize peak current drain.

9 Claims, 9 Drawing Figures

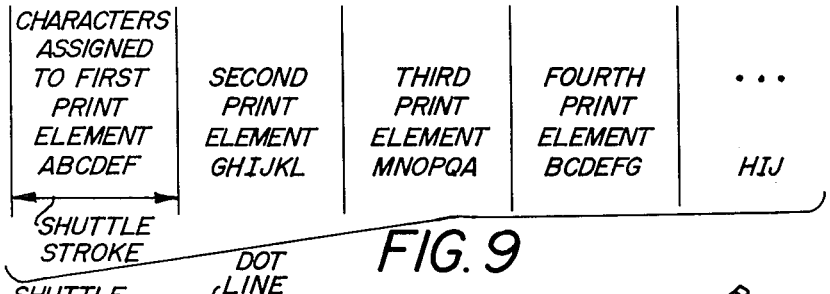
FIG. 9
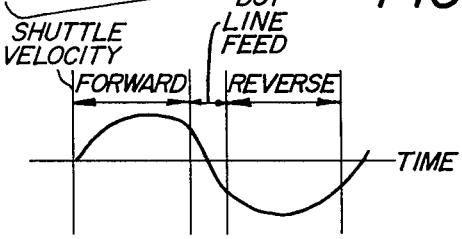
FIG. 8
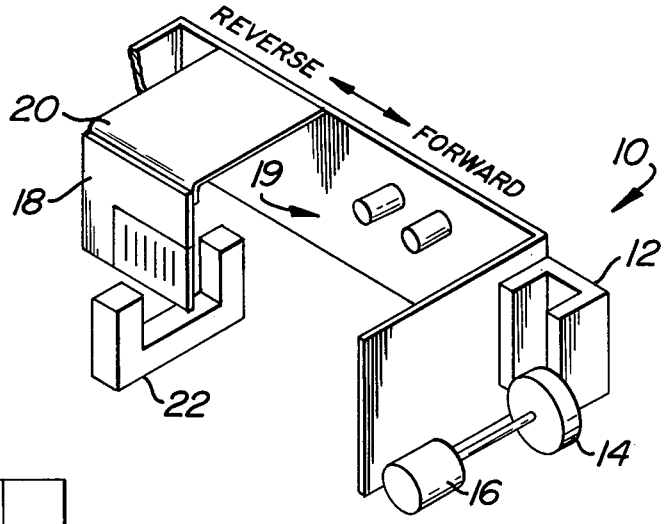
FIG. 1
FIG. 2
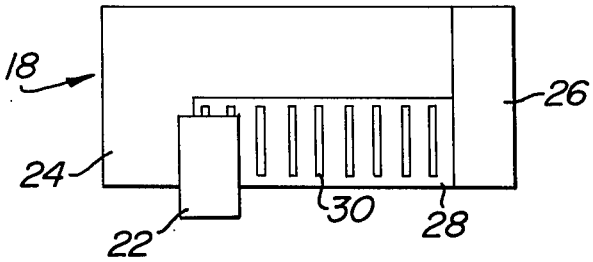
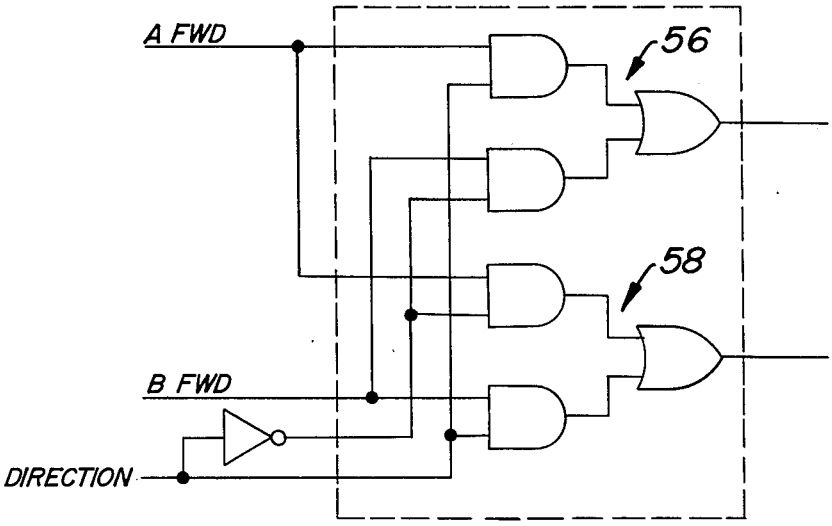
FIG. 5

$T_{DEC} \cong N/2\ T_{INC} - T_{FLIGHT}$

PRINTER SYNCHRONIZATION CONTROL FOR SHUTTLE HAVING NON-UNIFORM VELOCITY

BACKGROUND OF THE INVENTION

The present invention is directed to a printer synchronization control. In particular, the invention is directed to a synchronization control for maintaining columnar alignment of dots in characters printed by a dot matrix printer.

In a dot matrix printer, characters are printed on paper by selectively printing dots in a matrix arrangement. A shuttle is driven back and forth across the face of a paper or the like. Plural print elements are mounted on the shuttle. At preselected columnar positions on the paper, the print elements are caused to print a dot. A preselected arrangement of dots defines a character.

If the shuttle is driven at constant speeds back and forth across the paper, relatively cumbersome equipment is required to provide the forces necessary to repetitively stop and accelerate the shuttle. The relatively large forces required in utilizing such equipment results in considerable wear on the mechanical parts.

The magnitude of forces required in driving the shuttle can be substantially reduced by driving the shuttle at a non-uniform velocity. For example, the shuttle can be driven back and forth across the paper at a sinusoidally varying velocity. This allows relatively compact, low torque equipment to be used in replacement of the aforesaid cumbersome equipment. As a result, the wear on component parts is substantially reduced.

In such a printer, however, the dots produced by the print elements to define a character will not fall into columnar alignment. This is due to the constant flight times of the print elements and the varying shuttle velocity. The flight time of a print element is the time required for the element to impact the paper after being energized. The print element impacts the paper at preselected columnar positions of a character. The dots in a column are successively impacted as the shuttle alternately travels in opposite directions across the paper. Thus, although the flight time is constant, the print element traverses a columnar position on the paper at slightly different velocities as the shuttle reverses its direction of travel. This results in misalignment of the dots along a column of a character.

A primary advantage of the present invention is that it maintains the columnar alignment of dots in a character produced by a dot matrix printer wherein the shuttle is driven at non-uniform velocities back and forth across the paper.

Another advantage of the invention is that it permits the use of compact, low torque equipment in driving the shuttle.

Other advantages appear hereinafter.

BRIEF SUMMARY OF THE INVENTION

In a dot matrix printer including a shuttle and plural print elements mounted thereon wherein the relative velocity between the paper and shuttle is non-uniform, a printer synchronization control maintains the columnar alignment of the dots. The relative velocity between the paper and shuttle is measured over a period of time which is inversely proportional to the relative velocity. The time at which a printer actuator must be triggered to cause a print element to strike the paper at a preselected columnar position is determined. The print element is caused to strike the paper at the preselected position as a function of the time at which the print actuator must be triggered. Flight time is automatically compensated for.

At least two sets of print elements can be caused to strike the paper at preselected columnar positions in time-staggered fashion by separately determining the times at which each set of elements must be actuated.

BRIEF DESCRIPTION OF THE DRAWING

For the purpose of illustrating the invention, there is shown in the drawing a form which is presently preferred; it being understood, however, that this invention is not limited to the precise arrangements and instrumentalities shown.

FIG. 1 is a perspective view of a shuttle and print elements driven at non-uniform velocities back and forth across a paper or the like which is divided into columns.

FIG. 2 is a front view of a timing strip and sensor.

FIG. 5 is an electrical schematic of the AND-OR circuitry in FIG. 4.

FIG. 8 is a diagram of a sinusoidal shuttle velocity waveform.

FIG. 9 is a diagram of the character field traversed by each print element during a shuttle stroke, each character being a 5 × 7 dot matrix.

DETAILED DESCRIPTION OF THE INVENTION

Figure 3:
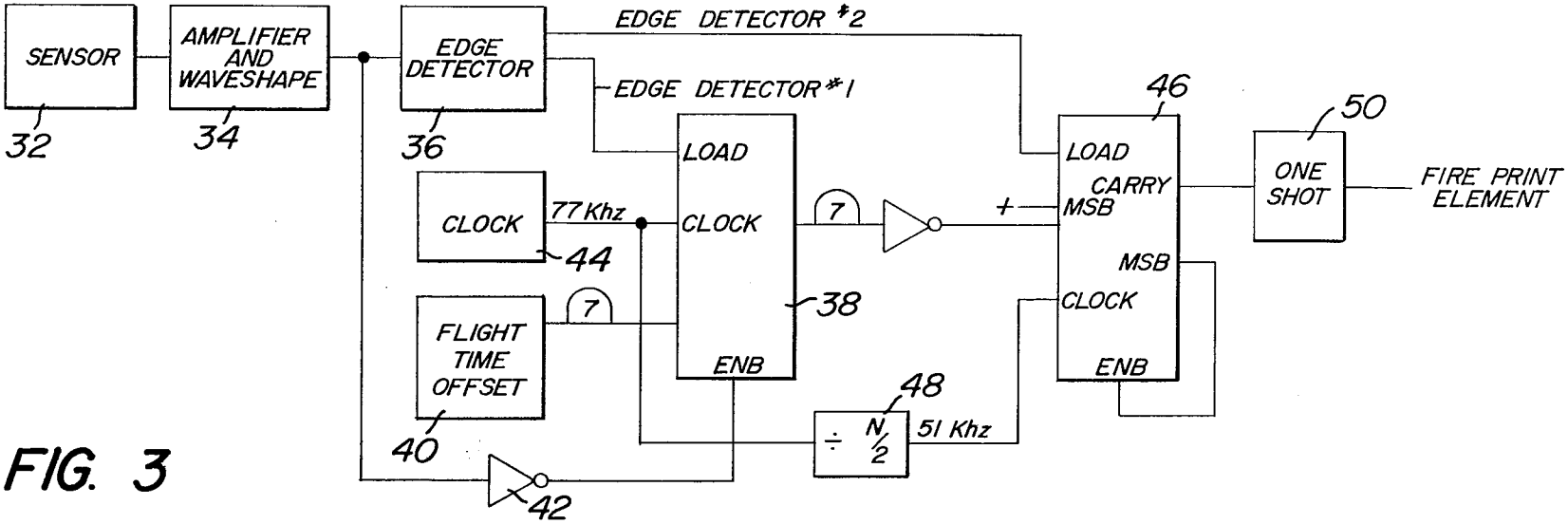
FIG. 3 is a block diagram of a printer synchronization control constructed in accordance with the principles of the present invention.

Referring to the drawing in detail, wherein like numerals indicate like elements, there is shown in FIG. 1 a shuttle 10 in a dot matrix printer for alternately traversing a paper in forward and reverse directions. The shuttle 10 traverses one line of dot positions on the paper in the forward direction, feeds a dot line, and then traverses the next line of dot positions on the paper in the reverse direction. The shuttle 10 is driven back and forth across the paper until all lines of the paper have been traversed in this fashion. In the preferred embodiment described herein, the non-uniform velocity of the shuttle 10 is sinusoidal. A yoke 12 is mounted on the shuttle 10 and cooperates with a cam 14 driven by a motor 16 to vary the shuttle velocity in sinusoidal fashion.

The shuttle 10 is provided with plural print elements 19 mounted thereon. Preferably, there are 22 such elements 19 although other numbers of print elements 19 may also be used as will be evident from the following disclosure. When actuated, each print element 19 impacts the paper to produce a dot at a preselected columnar position. In the preferred embodiment described herein, each line of the paper may accomodate 132 characters. Such character is formed by impacting the paper at preselected positions in a 5 × 7 dot matrix. A timing strip 18 is mounted on a bracket 20 secured to the shuttle 10. A U-shaped housing 22 straddles the timing strip 18. The housing 22 is secured in place and does not move with the shuttle 10. The timing strip 18 comprises an opaque portion 24, a transparent portion 26, and a transparent portion 28 provided with opaque slits 30. See FIG. 2.

In a preferred embodiment, the shuttle 10 is approximately 13 inches long and the timing strip 18 is approximately 0.6 inch long. The stroke of the shuttle 10 in each direction is also approximately 0.6 inch long. A light emitting diode and phototransistor (not shown) are mounted in the housing 22 to face each other on opposite sides of the timing strip 18. The opaque portion 24 of the timing strip 18 is used to indicate that the shuttle 10 is in position at the beginning of a line. The transparent portion 26 of the timing strip 18 is used to indicate that the shuttle 10 has reached the home position at the end of a forward stroke.

The light emitting diode and phototransistor comprise a sensor 32. See FIG. 3. The sensor 32 produces a sinusoidally varying output as the timing strip 18 moves with shuttle 10. See FIG. 6. The portion of the wave form labeled "start" corresponds to the position of the housing 22 (and light emitting diode and phototransistor) adjacent the opaque portion 24 of the timing strip 18. The portion of the wave form labeled "home" corresponds to the position of the housing 22 adjacent the transparent portion 26 of the timing strip 18. The intermediate portions of the wave form, labeled "forward" and "reverse", correspond to the forward and reverse motion of the timing strip 18 with the shuttle 10 across the transparent portion 28. The peaks of the sinusoidal portions of the wave form correspond to the sensor 32 in juxtaposition with an opaque slit 30. The valleys correspond to the sensor 32 in position between opaque slits 30.

Figure 6:
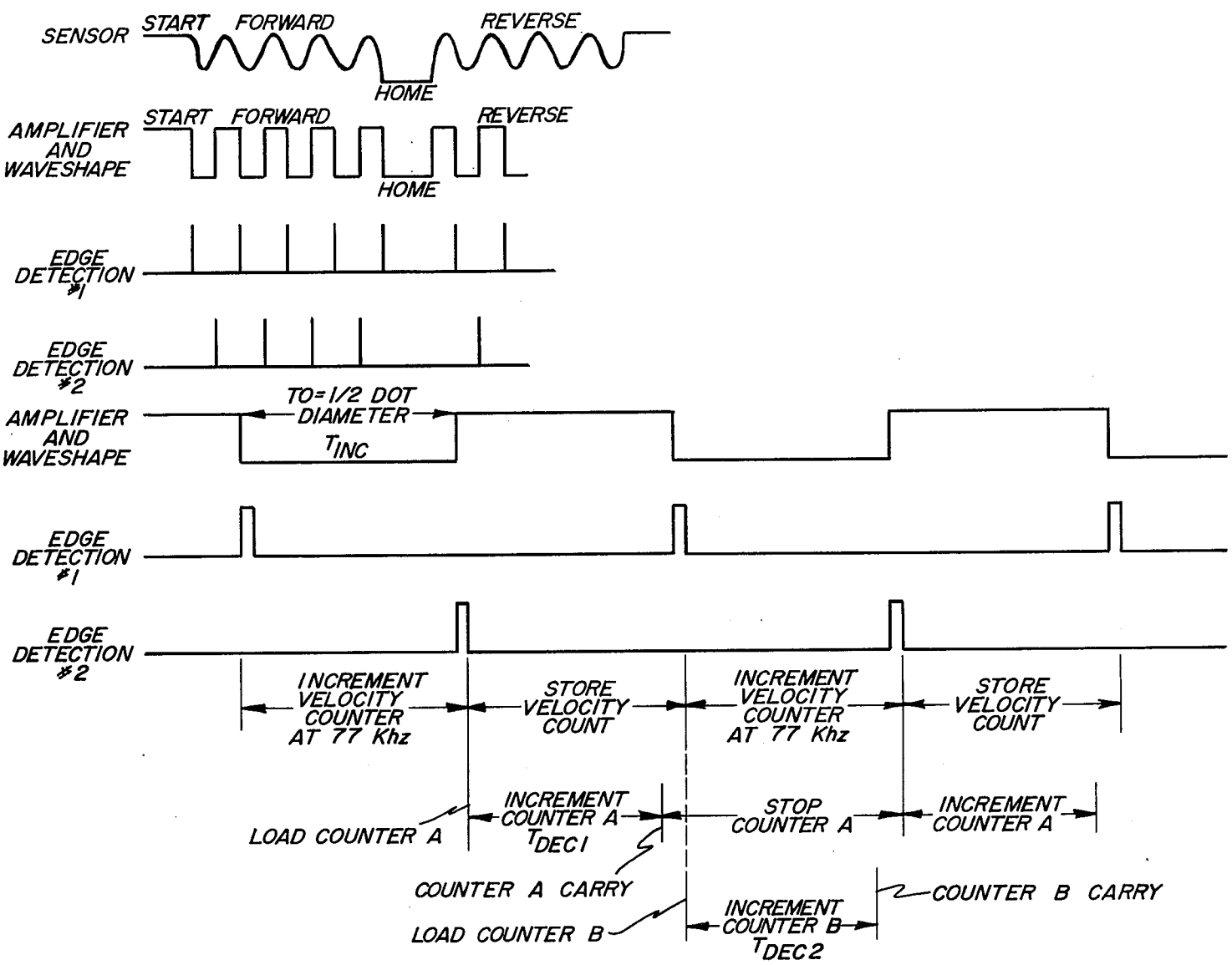
FIG. 6 is a diagram of the wave forms generated in FIGS. 3 and 4.

The sensor output is amplified and shaped by amplifier and wave shape circuit 34. See FIG. 3. The output of amplifier and wave shape circuit 34 is shown in FIG. 6. This output provides the basic timing signal for computing the times at which the print elements 19 must be actuated to maintain columnar alignment of the dots for each character. As described more fully hereinafter, the time *T*dec at which a print element 19 must be actuated can be computed according to the following algorithm:

$$T\text{dec} = (N/2)T\text{inc} - T\text{flight}$$

*T*inc represents the time during which sensor 32 is in between opaque slits 30. As such, *T*inc is inversely proportional to the shuttle velocity. During this time, the shuttle velocity is measured. *T*flight is the flight time of a print element 19. This time is constant. *T*dec is the time elapsed after the measurement interval *T*inc at the expiration of which the print element 19 must be actuated to maintain columnar alignment of the dots in a character. The number N is an integer which, for reasons appearing more fully below, must be greater than the ratio of 2 × *T*flight to the minimum value of *T*inc. The minimum value of *T*inc is determined by the maximum velocity of the shuttle 10.

Figure 7:
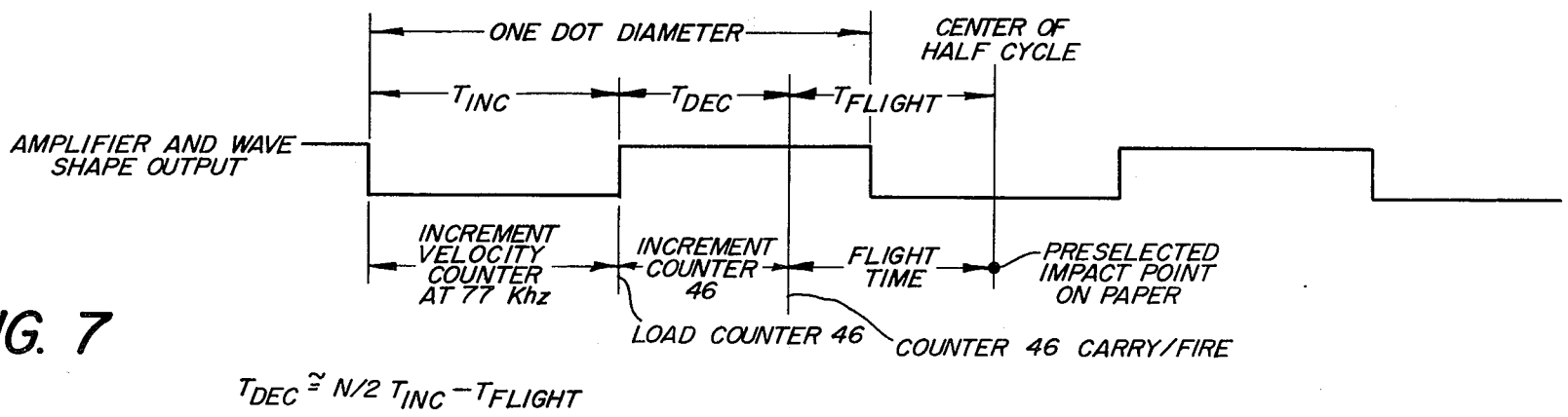
FIG. 7 is an exploded diagram of the amplifier and wave shape output identifying the time quantities used in solving an algorithm for determining the time at which a print element must be actuated.

Referring to FIG. 7, it will be noted that the output of the amplifier and wave shape circuit 34 is a square wave having a 50% duty cycle. The impact point of the print element 19 on the paper is chosen to coincide with the center of a half cycle of the square wave since the same impact point is desired for both forward and reverse directions of travel of the shuttle 10. If the impact point were located off center of a half cycle, the dots printed in the forward and reverse directions of travel would not align. The impact point should also be located at the half cycle nearest the measurement interval *T*inc. Thus, during the computation of the time *T*dec, the change in shuttle velocity should be as small as possible. The farther away the impact point is located from the measurement interval *T*inc, the greater the change in shuttle velocity during the computation time hence the greater the inaccuracy of the computation. Each half cycle that the impact point is displaced from the measurement interval *T*inc is equivalent to incrementing the integer N by two. The preferred location of the impact point is the half cycle nearest the measurement interval *T*inc.

To ensure that the algorithm above can be computed, the value of the integer N must be sufficiently great so that *T*dec is greater than zero. This can be restated in terms of the mathematical inequality:

$$N > 2T\text{flight}/T\text{inc minimum}$$

As previously mentioned, the minimum value of *T*inc is determined by the maximum velocity of the shuttle 10. In the preferred embodiment herein, the minimum value of *T*inc is 400 microseconds and the print element flight time, *T*flight, is 450 microseconds. Accordingly, the integer N must be greater than 2. In the following description of the invention, the optimal value of the integer N is 3.

Referring to the block diagram of the printer synchronization control shown in FIG. 3, the amplifier and wave shape circuit output is fed to a bidirectional edge detector 36. The outputs of the edge detector 36 are denoted "edge detector No. 1" and "edge detector No. 2". These outputs comprise a series of brief pulses coinciding with the leading and trailing edges of the negative half cycles of the amplifier and wave shape circuit output. See FIG. 6. Each pulse of the "edge detector No. 1" output loads a velocity counter 38 with the parallel digital outputs of a flight time offset circuit 40. See FIG. 3. The flight time offset circuit 40 comprises a series of switches which are fixed to provide a signal output representative of the digital complement of the flight time of the print elements 19. The velocity counter 38 is an eight bit up counter assembled from commercially available integrated circuit chips such as a TI SN74LS161 chip.

The velocity counter 38 is gated on by the inverted replica of the amplifier and wave shape circuit output via inverter 42. Thus, immediately after the counter 38 is loaded with the complement of the flight time, it is enabled to count the pulses generated by a clock oscillator 44. In the preferred embodiment herein, the clock oscillator 44 generates a 77 Khz digital pulse train to increment the velocity counter 38. The velocity counter 38 counts up the 77 Khz pulses until the output of the amplifier and wave shape circuit 34 changes state to indicate that the measuring interval *T*inc has ended. The contents of the counter 38 will be directly proportional to *T*inc, hence inversely proportional to the shuttle velocity.

When the velocity counter 38 is gated off by the output of inverter 42, a second counter 46 is loaded by the "edge detector No. 2" output with the complementary outputs of counter 38 except the most significant bit output. Counter 46 is also an up counter assembled from commercially available integrated circuit chips such as the TI SN74LS161 chip. The most significant bit input of counter 46 is fixed at a binary "1". The most significant bit output of counter 46 is connected back to its enable input. Accordingly, when the counter 46 is loaded, it is also enabled to count upwardly in response to the output of a divide by N/2 circuit 48. As mentioned previously, in the preferred embodiment herein, the value of N is 3 so the circuit 48 is a divide by 3/2 circuit having a 51 Khz output. Counter 46 counts up in response to the 51 Khz signal. The carry output of the counter 46 triggers a one shot 50. The one shot 50 fires a conventional actuator to cause the print element 19 to impact the paper at the preselected impact point. In particular, the one shot 50 fires the actuator the precise time *T*dec following the measuring interval *T*inc for the print element 19 to strike the paper at the preselected point.

From the foregoing, it should be apparent that the printer synchronization control circuit shown in FIG. 3 computes the time period *T*dec according to the algorithm:

$$T\text{dec} = (3/2)T\text{inc} - T\text{flight}$$

Thus, for any given print element flight time, the circuit maintains columnar alignment of the dots printed by the matrix printer for each character as the shuttle 10 traverses the paper in forward and reverse directions at non-uniform velocities. The relationship between the above quantities is graphically shown in FIG. 7.

The printer synchronization control described above solves the problem of columnar dot alignment for a shuttle 10 which traverses the paper in reverse and forward directions at non-uniform velocities. The circuit actuates a plurality of print elements 19 simultaneously to cause plural characters to be printed out on the paper at the same time. For example, each line of the paper may be able to accommodate 132 characters, each character define by a 5 × 7 dot matrix. There may be 22 print elements 19 employed to print all of the characters, each print element 19 being assigned 6 adjacent characters. As the shuttle 10 traverses the paper in either direction, each print element 19 prints a dot at selected columnar positions of each of its assigned characters. See FIG. 1.

Actuating all 22 print elements 19 simultaneously presents a considerable current drain on the system power supply. To limit the peak current drain on the supply, it is desirable to actuate the print elements 19 in time-staggered fashion so that less than all of the elements 19 are actuated simultaneously. The print elements 19 may be divided into any number of different sets for this purpose. For purposes of explanation, however, it is presumed that the elements 19 are divided into two sets, one comprising the first, third and other odd numbered print elements 19 and the other set comprising the second, fourth and other even numbered elements 19. See FIG. 1.

Figure 4:
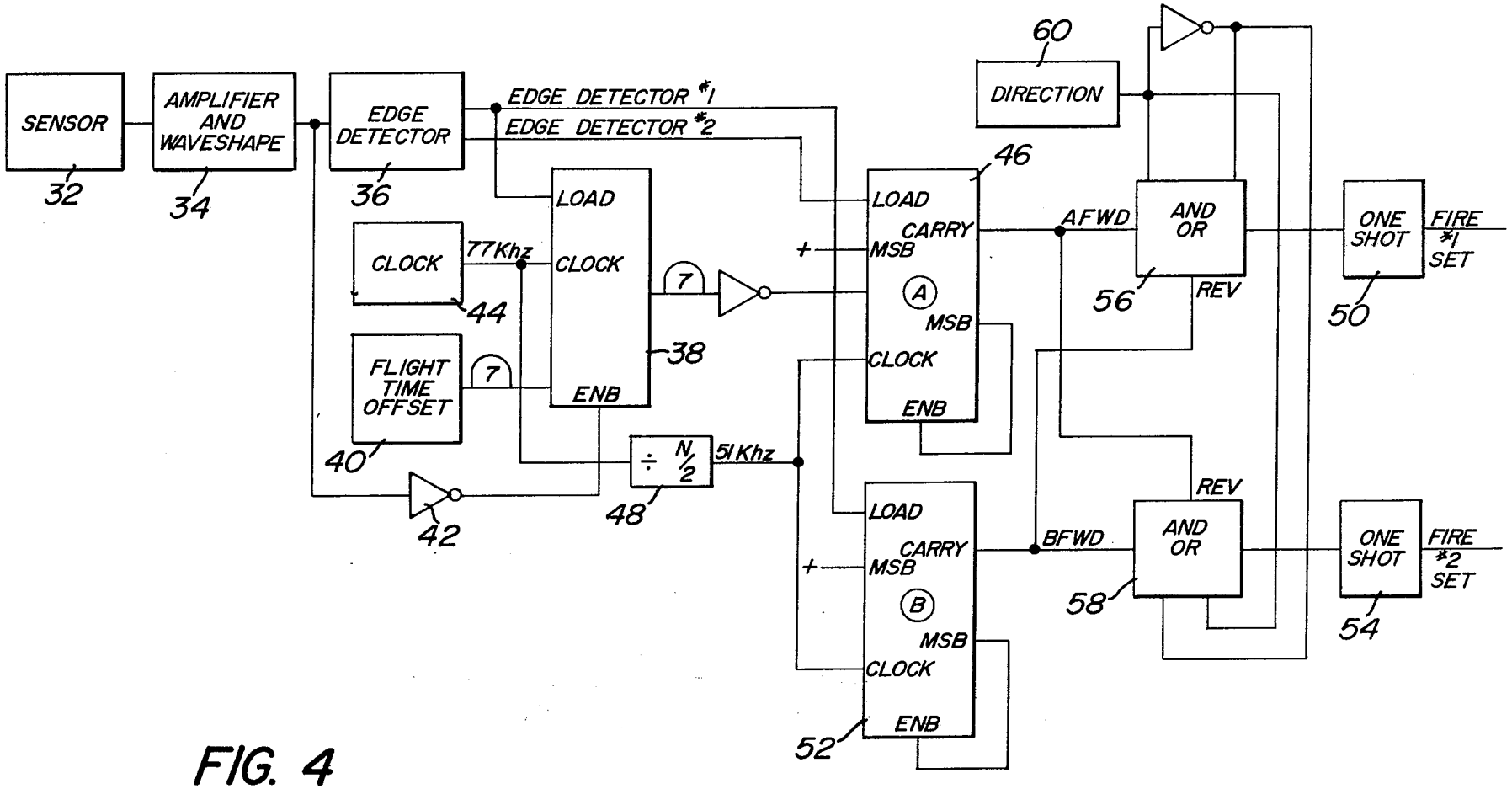
FIG. 4 is a block diagram of a printer synchronization control for operating at least two sets of print elements in time-staggered fashion according to the principles of the present invention.

A printer synchronization control circuit for time-staggered operation of the print elements 19 to limit power supply current drain is shown in FIG. 4. Like numerals in FIGS. 3 and 4 denote like elements. The edge detector No. 1 signal loads velocity counter 38 as previously described. Inverter 42 gates the velocity counter 38 on and off so that the counter 38 counts the 77 Khz pulses during the *T*inc interval. At the end of the *T*inc interval, the second counter 46 determines the interval *T*dec1 after which the one shot 50 is triggered to fire the first set of print elements 19 which are here presumed to be the odd numbered print elements 19. A third counter 52 and one shot 54 cooperate in similar fashion in response to the edge detector No. 1 signal and the 51 Khz pulses to fire the second set of print elements 19 at time *T*dec2 following the measurement interval *T*inc. Counter 52 is an eight bit counter identical to counter 46. It should be noted that when both counters 46 and 52 reach their carry count, the most significant bits disable the counters 46 and 52.

The AND-OR circuits 56 and 58 are connected between counters 46 and 48 and one shots 50 and 54 respectively to ensure that the order of firing of both sets of print elements 19 reverses as the direction of travel of the shuttle 10 reverses. A direction indicating circuit 60 is connected in any conventional manner to detect the direction of travel of the shuttle 10. The output of the direction indicating circuit 60 is combined with the outputs of counters 46 and 52 as shown in FIG. 5 to ensure that the order of firing of the sets of print elements 19 reverses.

In utilizing the printer synchronization control circuit shown in FIG. 4, the print elements 19 are divided into two sets as previously described. Whereas the print elements 19 are uniformly spaced for the circuit shown in FIG. 3, the relative positioning of the print elements 19 must be altered somewhat to compensate for the movement of the shuttle 10 during the interval between firing of each set of print elements 19 in utilizing the circuit in FIG. 4. In particular, the second set of print elements 19 must be positioned a half dot diameter closer to the first set. Thus, the physical width of each opaque slit 30 is approximately one half a dot diameter. This is indicated by the 50% duty cycle of the amplifier and wave shape circuit output. Each half cycle of the output therefore represents a one half dot diameter in terms of fixed time T0. See FIG. 6. Thus, the phase difference between edge detector No. 1 and 2 pulses is one half a dot diameter. Accordingly, the second set of print elements 19 is always fired half a dot diameter after the first set. Unless compensated for, the dot columns will be misaligned by one half a dot diameter due to the staggered firing of the two sets of print elements 19. To compensate for this effect, therefore, the second set of print elements 19 is positioned one half a dot diameter closer to the first set of print elements 19.

An advantage of the invention is that it maintains columnar alignment of the dots printed in each column of a character by print elements 19 mounted on a shuttle 10 which traverses a paper in forward and reverse directions at non-uniform velocities. Another advantage of the invention is that it maintains the columnar alignment of the dots while minimizing the peak current drain on the system power supply. This reduces noise spikes from the supply and enables the use of less cumbersome and less expensive wiring. A further advantage of the invention is that permits the use of relatively compact, low torque equipment to drive the shuttle 10.

Although the invention has been described in terms of up counters 38, 46 and 52, it should be understood that the counters could be replaced by down counters if desired. Up counters have been used since they are less expensive than down counters. It would be obvious to anyone skilled in the art, however, that down counters could be used in replacement of the up counters if the down counters are preset to the complements of the digital signals indicated above. Moreover, although the invention has been described in terms of a 132 character printer with 22 print elements 19, it should be understood that other size printers and other numbers of print elements 19 may also be used within the purview of the invention. Still further, although an embodiment of the invention for time staggering the firing of two sets of print elements 19 has been described, it should be evident that the print elements 19 may be segregated into more than two sets with obvious modifications to the circuitry. Finally, although a preferred embodiment of the invention has been described for solving the algorithm wherein the value of the integer N is 3, it should be understood that other values of the integer N can also be employed depending on the values of the print element flight time and the maximum velocity of the shuttle 10.

The present invention may be embodied in other specific forms without departing from the spirit or essential attributes thereof and, accordingly, reference should be made to the appended claims, rather than to the foregoing specification as indicating the scope of the invention.

I claim:

1. In a dot matrix printer including a shuttle and plural print elements mounted thereon for printing dots at preselected positions on a paper, wherein the relative velocity between the paper and the shuttle is non-uniform and wherein each of the print elements strikes the paper a finite time *T*flight after having been actuated, a printer synchronization control comprising:

means for measuring the relative velocity between the paper and the shuttle over a period of time *T*inc inversely proportional to the relative velocity;

means for determining the time *T*dec at which a print element must be actuated to strike the paper at a preselected columnar position; and means for causing the print element to strike the paper at said preselected position as a function of said time determining means.

2. A printer synchronization control in accordance with claim 1 wherein the time at which the print element must be triggered is determined by the relationship:

$$T\text{dec} = (N/2)T\text{inc} - T\text{flight}$$

where N is an integer greater than $2T\text{flight}/T\text{inc}$ minimum and where *T*inc minimum is the minimum value of *T*inc.

3. A printer synchronization control in accordance with claim 1 wherein said measuring means includes a clock oscillator for generating pulses at a fixed frequency and a velocity counter for counting the clock pulses over the period of time *T*inc.

4. A printer synchronization control in accordance with claim 3 wherein said time determining means includes a frequency divider circuit for dividing the frequency of the clock pulses by an integral multiple of one half, and a counter for counting the output of the frequency divider circuit over the interval of time *T*dec.

5. In a dot matrix printer including a shuttle and plural print elements divisible into at least two sets mounted on the shuttle for printing dots at preselected positions on a paper, wherein the relative velocity between the paper and shuttle is non-uniform and wherein each of the print elements strikes the paper a finite time *T*flight after having been actuated, a printer synchronization control comprising:

means for measuring the relative velocity between the paper and shuttle over a period of time *T*inc inversely proportional to the relative velocity;

means for determining the time *T*dec1 at which a first set of print elements must be triggered for the print elements to strike the paper at preselected columnar positions;

means for determining the time *T*dec2 at which a second set of print elements must be triggered for the print elements to strike the paper at preselected columnar positions; and means for causing the first and second sets of print elements to strike the paper in time-staggered fashion as a function of both of said time determining means.

6. A printer synchronization control in accordance with claim 5 wherein the time at which the first set of print elements must be triggered is determined by the relationship:

$$T\text{dec1} = (N/2)T\text{inc} - T\text{flight}$$

and wherein the time at which the second set of print elements must be triggered is determined by the relationship:

$$T\text{dec2} = (N/2)T\text{inc} - T\text{flight} + T0$$

where N is an integer and T0 is an interval of time determined by the relative velocity between the paper and shuttle.

7. A printer synchronization control in accordance with claim 5 wherein said means for measuring the relative velocity between the paper and shuttle comprises a clock oscillator for generating clock pulses at a fixed frequency, and a velocity counter for counting the clock pulses during the time interval *T*inc.

8. A printer synchronization control in accordance with claim 7 wherein said means for determining the times *T*dec1 and *T*dec2 comprises a frequency divider circuit for dividing the frequency of the clock pulses by an integral multiple of one half, a first counter for counting the output of said frequency divider circuit during the time interval *T*dec1, and a second counter for counting the output of said frequency divider circuit during the time interval *T*dec2.

9. A printer synchronization control in accordance with claim 6 wherein the interval of time T0 is equivalent to a fraction of the diameter of a dot.

* * * * *